United States Patent [19]

Ishikawa

[11] 4,396,295

[45] Aug. 2, 1983

[54] ELECTRONIC TIMEPIECE WITH DOT MATRIX DISPLAY

[75] Inventor: Takehiro Ishikawa, Tokyo, Japan

[73] Assignee: Kabushiki Kaisha Daini Seikosha, Tokyo, Japan

[21] Appl. No.: 186,535

[22] Filed: Sep. 12, 1980

[30] Foreign Application Priority Data

Sep. 20, 1979 [JP] Japan ..... 54-121390

[51] Int. Cl.[3] ..... G04C 19/00; G04C 15/18

[52] U.S. Cl. ..... 368/82; 368/239; 368/792

[58] Field of Search ..... 340/792, 755; 368/82–84, 239–242, 223, 231

[56] References Cited

U.S. PATENT DOCUMENTS

| | | | |
|---|---|---|---|
| 3,384,888 | 5/1967 | Harnden, Jr. et al. | 340/793 X |
| 3,433,846 | 3/1969 | Jones et al. | 340/792 X |
| 3,566,388 | 2/1971 | Andrews et al. | 340/792 |
| 3,707,071 | 12/1972 | Walton | 368/241 X |
| 3,772,874 | 11/1973 | Lefkowitz | 368/242 |
| 3,982,239 | 9/1976 | Sherr | 368/239 X |
| 4,084,402 | 4/1928 | Moyer | 368/83 |
| 4,138,626 | 2/1979 | Unotoro et al. | 368/240 X |
| 4,205,312 | 5/1980 | Nelson | 340/792 |
| 4,255,804 | 3/1981 | Suganuma | 368/239 X |

*Primary Examiner*—Vit W. Miska

*Attorney, Agent, or Firm*—Robert E. Burns; Emmanuel J. Lobato; Bruce L. Adams

[57] ABSTRACT

An electronic timepiece has time-keeping circuitry for generating time signals representative of different units of time such as minute, hour, day and date. An elongate dot matrix display displays time information in character form in response to drive signals applied thereto, and electronic circuitry processes the time signals and produces a plurality of sets of drive signals each representative of a different unit of time and applies the sets of drive signals to the dot matrix display to cause the dot matrix display to sequentially display therealong in a repetitive sweeping motion different sets of characters corresponding to the different units of time.

5 Claims, 10 Drawing Figures

ELECTRONIC TIMEPIECE WITH DOT MATRIX DISPLAY

BACKGROUND OF THE INVENTION (1) Field of the Invention

The present invention relates to an electronic timepiece with a dot matrix display having a sweep display.

(2) Description of the Prior Art

In the conventional multi-function digital display method, an hour, minute and second display is changed into a month and date display or the hour, minute and second display is changed into an alarm hour and minute on the same display device. The change-over operation of the display becomes more complicated with an increase in the number of functions of the timepiece. Further, the change-over display method is uniform since the display only immediately changes at the instant it is changed over. Further, it is difficult to read out the display by shifting the display position since the form of the display character is like a figure "8" which consists of seven segments.

SUMMARY OF THE INVENTION

Accordingly, it is an object of the present invention to overcome the above noted drawbacks and to provide a display in the form of a dot matrix, and to sweep time information and the like at a relatively low sweep frequency (e.g. 4 Hz) when the display is changed over so that a number of different informations can be displayed by a single operation.

It is another object of the present invention to provide an electronic timepiece for sweeping the display of an arbitrary frequency.

It is a further object of the present invention to provide an electronic timepiece with dot matrix display having a time counting circuit, a character generator for decoding the counting content of the time counting circuit, a shift means for retaining an output from the character generator temporarily, an optical display device having plural elements arranged in the form of a dot matrix and a, control circuit for controlling the character generator and the shift means, wherein plural shift pulses are fed to the shift means in response to an external switching operation, and information including at least time information to be displayed are displayed by sweeping at an arbitrary frequency.

DESCRIPTION OF THE PREFERRED EMBODIMENT

Hereinafter the present invention will be illustrated in conjunction with the accompanying drawings, in which embodiments to sweep a time information and a calendar information will be illustrated.

Figure 1:
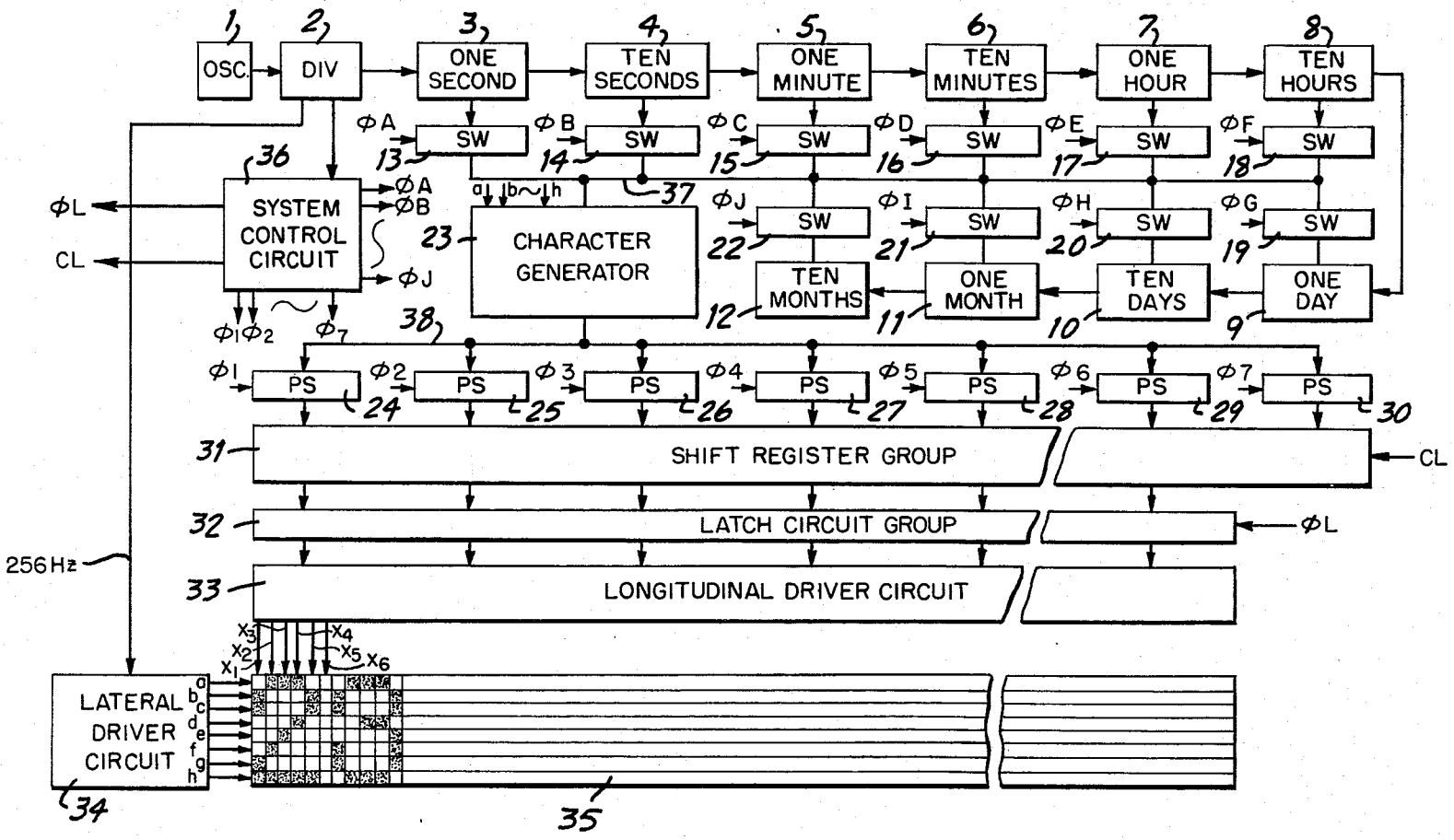
FIG. 1 is a block diagram of a part of an electronic timepiece according to the present invention.

FIG. 1 shows a block diagram of electronic timepiece circuitry according to the present invention. Reference numeral 1 denotes an oscillator, 2 denotes a frequency divider, 3 denotes an one second figure counter, 4 denotes a ten seconds figure counter, 5 denotes an one second figure counter, 6 denotes a ten seconds figure counter, 7 denotes an one hour figure counter, 8 denotes a ten hours figure counter, 9 denotes an one day figure counter, 10 denotes a ten days figure counter, 11 denotes an one month figure counter and 12 denotes a ten months figure counter. An electronic switching circuit group is comprised of switching circuits 13 to 22 which are controlled by control signals $\phi A$ to $\phi J$. Numeral 23 denotes a character generator, and numerals 24 to 30 are preset circuits which together form a preset circuit group with the preset circuits being controlled by control signals $\phi_1$ to $\phi_7$. Numeral 31 is a shift register group, 32 is a latch circuit group, 33 is a longitudinal driver circuit, 34 is a lateral driver circuit, 35 is a dot matrix display and 36 is a system control circuit.

The connection and operation of each circuit will be illustrated hereinbelow, except for the circuitry operation from the oscillator 1 to the ten months figure counter 12 which has been omitted since such comprises well known time counting circuits.

The counting outputs from the figure counters 3 to 12 are respectively connected to a bus line 37 by way of the electronic switching circuits 13 to 22 respectively. The bus line 37 is connected to the character generator. The output from the character generator 23 is connected to a bus line 38 which is connected to each input terminal of the preset circuits 24 to 30 whose outputs are connected to respective ones of the preset input terminals of the shift register group 31. Most of the outputs from the shift register group 31 are connected to input terminals of the latch circuit group 32, and the outputs from the the latch circuit group 32 are connected to the longitudinal driver circuit 33, and the outputs from the longitudinal driver circuit 33 are connected to longitudinal segments of the display 35.

A 256 Hz-signal is fed to the lateral driver circuit 34 from the frequency divider 2, and scanning signals "a" to "h" produced from the lateral driver circuit 34 are applied to the character generator 23 and to lateral segments of the display 35 respectively. The system control circuit 36 receives an arbitrary signal from the frequency divider 2, and produces signals $\phi A$ to $\phi J$, $\phi_1$ to $\phi_7$, $\phi L$ and a CL pulse.

Figure 3:
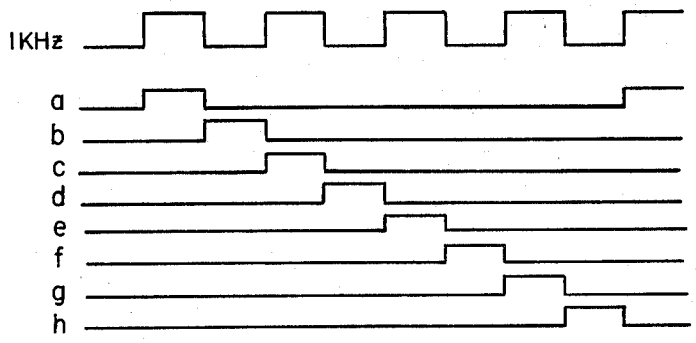
FIGS. 3, 4, 5 and 6 are time charts.

The signals $\phi A$ to $\phi J$ are connected to the respective control terminals of the electronic switching circuit group 13 to 22 as shown. The signals $\phi_1$ to $\phi_7$ are connected to the respective preset input terminals of the preset circuit group 24 to 30 as shown. The signal $\phi L$ is connected to the control terminal of the latch circuit group 32 and the CL pulse signal is connected to he shift clock input terminal of the shift register group 31. The scanning signals "a" to "h" produced from the lateral driver circuit 34 sequentially become at high logic level "1" as shown in the time chart in FIG. 3 and drive the lateral segments on the display 35.

Hereinafter, the system control circuit 36 for operating the whole system will be described in detail with reference to in FIG. 2.

Reference numeral 50 denotes a 7 stage-shift register, 51 denotes a gate circuit, 52 denotes a 10-counter, 53 denotes a preset circuit, 54 denotes a 10-counter, 55 denotes a flip-flop, 56 denotes an AND circuit, 57 denotes a 6-counter, 58 denotes a gate circuit, 59 denotes an OR circuit, 60 denotes a one shot pulse generator and SW denotes an external switch.

A 1 KHz-signal is fed to the 7 stage-shift register 50 and the 10-counter 52 respectively.

Figure 4:
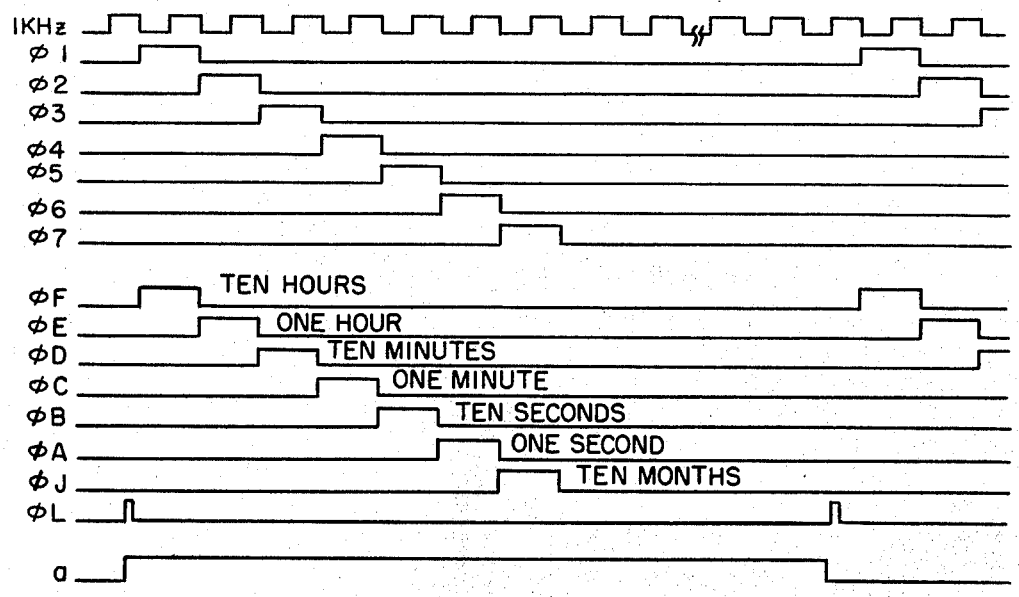
Figure 5:
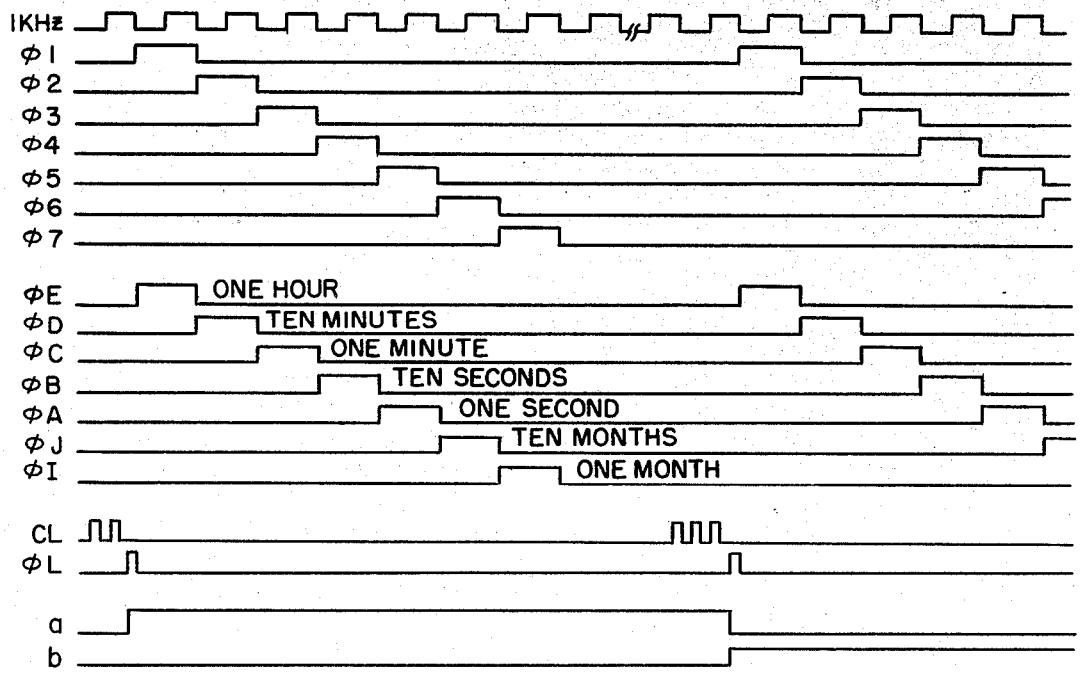

The 7 stage-shift register 50 produces the $\phi_1$ to $\phi_7$ pulses at the timings shown in FIGS. 4 and 5. A 256 Hz-signal generates the $\phi$L signal by way of the one shot pulse generator 60. The $\phi$L signal is generated at the timing shown in FIGS. 4 and 5 in te same way. The $\phi$L signal is a narrow pulse produced per each pulse from "a" to "h". The external switch SW is connected to the input terminal of the flipflop 55 where Q output is connected to one input terminal of the AND circuit 56. To the other input terminal of the AND circuit 56 is connected to receive a 4 Hz-signal (which becomes the sweep frequency signal) and the output terminal from the AND circuit 56 is connected to the input terminal of the 6-counter 57. The counting outputs of the 6-counter 57 are fed to the gate circuit 58. To the gate circuit 58 are also fed I to VI pulses shown by a time chart in FIG. 6 and the outputs from the gate circuit 58 are connected to input terminal of the OR circuit 59. An output from the OR circuit 59 becomes the CL pulse signal.

A carry output of the 6-counter 57 is applied to the input terminal of the 10-counter 54. The counting outputs of the 10-counter 54 are respectively applied to the preset input terminals of the 10-counter 52 by way of the preset circuit 53. The counting outputs of the 10-counter 52 are respectively fed to the gate circuit 51. The gate circuit 51 receives and combines the counting contents of the 10-counter 52 so as to produce the pulses $\phi$A or $\phi$J.

Now the operation of the system control circuit 36 will be explained in conjunction with the time chart and the drawings.

Figure 2:
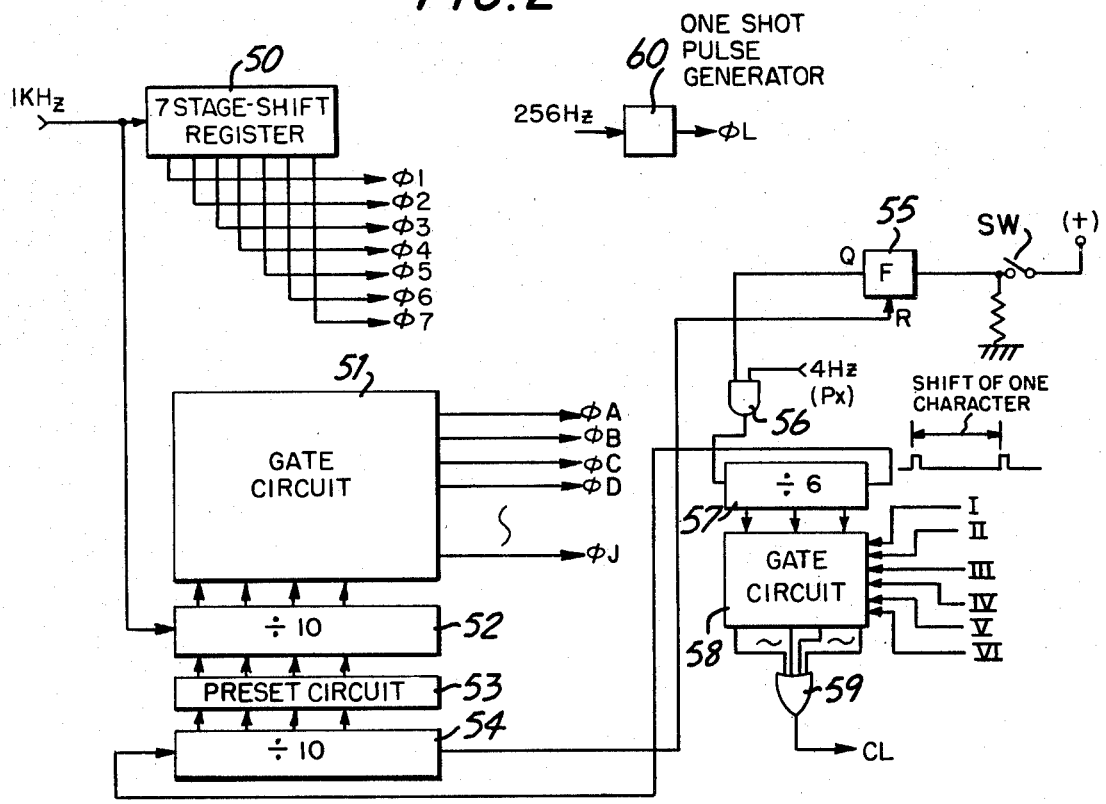
FIG. 2 is a detailed view in block diagram form of a system control circuit according to the present invention.

When the Q output of the flipflop 55 in FIG. 2 is at a "0" level, the display is not swept and remains at the rest condition, and the AND circuit 56 is closed, so that the 6-counter 57 is also at a "0" level. On this occasion, the gate circuit 58 selects the I signal (a "0" level shown in FIG. 6), and the CL pulse signal, which is the output from the OR circuit 59, is not produced. The pulses $\phi_1$ to $\phi_7$ produced from the 7 stage-shift register 50 shown by the time chart in FIG. 4 are repeatedly generated at a period of 1 KHz. And the 10-counter 54 is at a "0" level, the countings of the 10-counter 52 are 1 to 10, and the counting contents of the 10-counter 52 become the sequence of pulses $\phi$F to $\phi$J shown in FIG. 4 by the gate circuit 51. The $\phi$F to $\phi$J pulses ar produced in order of the timings to turn on the electronic switch group 18 to 13 and 22 in turn. Namely, the counter code transferred to the bus line 37 is in the order of ten hours→ one hour→ten minutes→one minute→ten seconds→one second→ten months. These counter codes are decoded into corresponding character data by the character generator 23 and transferred to the bus line 38. Since the preset circuit group 24 to 30 is controlled by the pulses $\phi_1$ to $\phi_7$, the counter codes are preset in the order of ten hours, one hour, ten minutes, one minutes, ten seconds, one second and ten months from the left side of the shift register group 31. Since the scanning signals "a" to "h" are fed to the character generator 23, the character data in accordance with each of the scanning signals are retained in the shift register group 31. The shift register group does not act at this time as the shift register since the CL pulse signal which is the shift clock pulse, is not fed. After this, the latch circuit group 32 operates (i.e., reads) at the timing shown by the $\phi$L signal in FIG. 4. Namely, most of the contents retained in the shift register 31 is read by the latch circuit group 32. On this occasion, the character data representative of ten months figures retained in the right side of the shift register group 31 is not read. Then the longitudinal driver circuit 33 operates in accordance with the outputs from the latch circuit group 32 to drive the display 35. As illustrated above, the latch circuit 32 reads the new character data in turn at the frequency of 256 Hz, i.e., corresponding to each of the scanning signals "a" to "h", and thereby the display 35 can display the matrix display as shown in FIG. 1.

Figure 6:
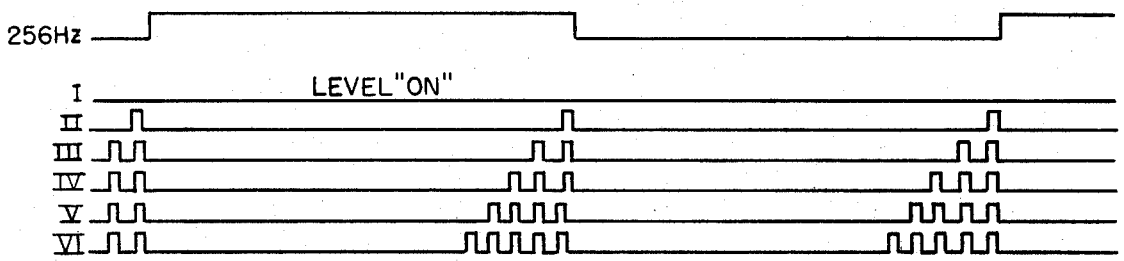

Referring now to the sweeping operation of the character, if the external switch SW is ON, the Q output of the flipflop 55 is at a "1" level. Then the AND circuit 56 opens and the 6-counter 57 starts counting at 4 Hz. Accordingly one of the II to VI pulses shown in FIG. 6 is selected with the frequency of 4 Hz, and the C pulses are produced from the OR circuit 59. The CL pulses are produced at a timing as shown in FIG. 5. Namely, the shift pulse shifts in a way of 1→2→3→4→5→0→1 . . . at a period of 4 Hz and each shift register in the shift register group 31 respectively shifts. This operation means that the longitudinal driving signal of the display 35 in FIG. 1 is shifted in the leftward direction at 4 Hz. The latch circuit group 32 also reads the characters shifted in the leftward direction.

When the 6-counter 57 in FIG. 2 generates a carry signal, i.e. when the 6-counter 57 shifts to the left by 5 lines, the 10-counter 54 becomes at a "1" level and the 10-counter 52 starts counting from "1". Then $\phi$A to $\phi$J signals produced $\phi$C→$\phi$B→$\phi$A→$\phi$J→$\phi$I as shown in FIG. 5.

These outputs respectively correspond to one hour figure, ten minutes figure, one minute figure, ten seconds figure, one second figure, ten months figure, and one month figure. Thus when the character, i.e., the ten hours figure on this occasion, completes its sweep to the left, the one hour figure is displayed on the left side of the display 35. Accordingly, the display 35 on this occasion displays one hour, ten minutes, one minute, ten seconds, one second and ten months from the left to the right.

After this, the shift display can be made in the same way, and after the sweeping operation is over, the carry signal of the 10-counter 54 in FIG. 2 resets the flipflop 55.

Figure 7A:
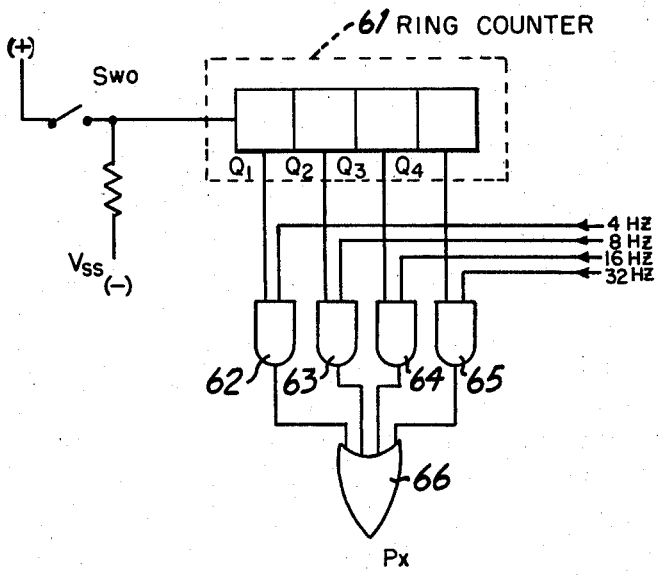
FIG. 7A is a switching circuit for determining the sweeping speed.

FIG. 7A shows a switching circuit for determining the sweeping speed. A manually operable switch member Swo is located at the surface of the electronic wrist watch. A ring counter 61 selects the 4 Hz-frequency signal which is applied to the AND circuit 56 by one operation of the switch member Swo. At this time, the contents of the ring counter 61 are

| 1 | 0 | 0 | 0 |
|---|---|---|---|

And also the ring counter 61 selects the 8 Hz-frequency signal which is applied to the AND circuit 56 by a second operation of the switch member Swo. At this time, the contents of the ring counter 61 are

| 0 | 1 | 0 | 0 |
|---|---|---|---|

Figure 7B:
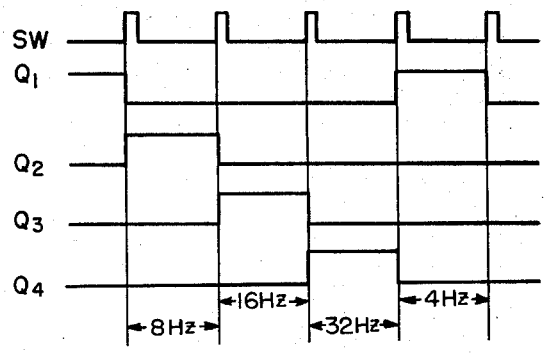
FIG. 7B is a time chart of the switching circuit operation.

FIG. 7B shows the selected output signal of the ring counter 61 which is used as the sweeping signal.

Namely, one of the 4 Hz, 8 Hz, 16 Hz and 32 Hz-frequencies is selected by the operation of the switch member Swo.

As a result, the operator can obtain the desired sweep-speed of the displayed character.

Figure 8:
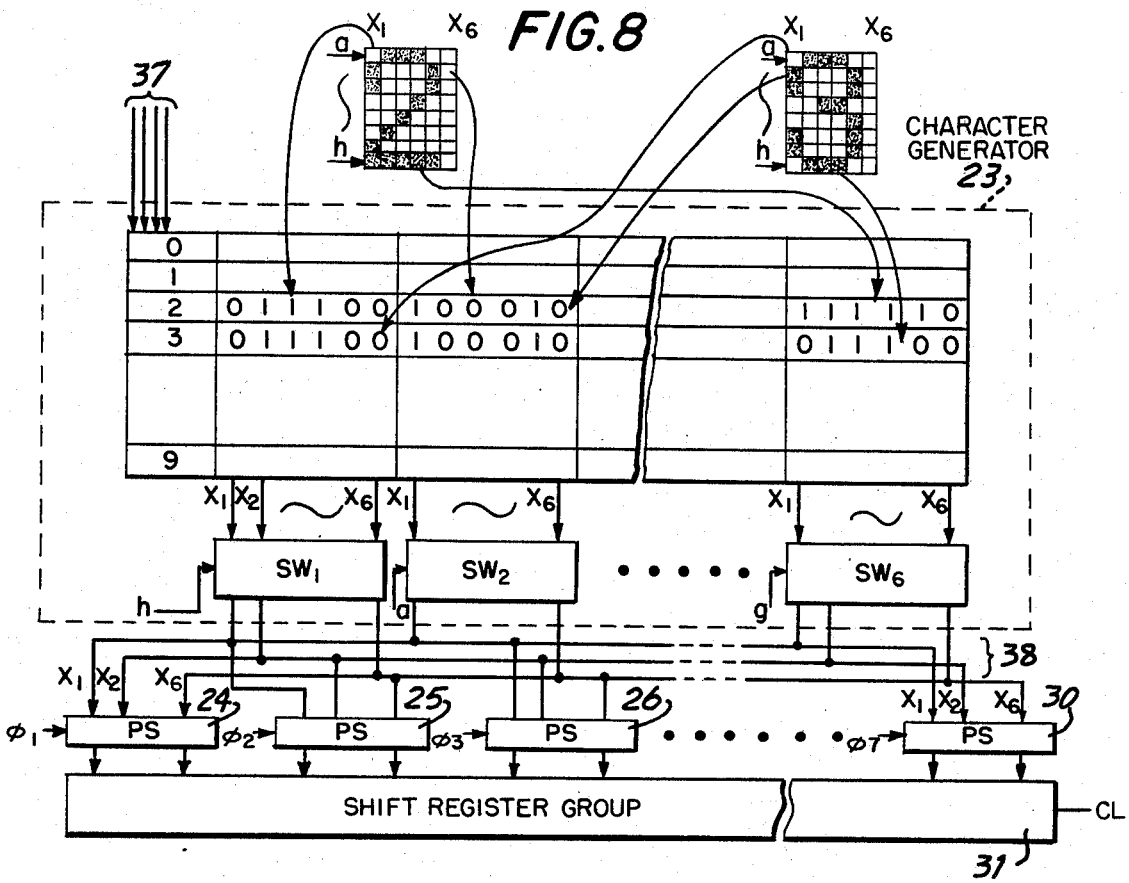
FIG. 8 is a circuit diagram showing a character generator.

FIG. 8 shows a circuit diagram of the character generator 28. Assuming now that the character generator 23 receives the counter code

| 0 | 1 | 0 | 0 |
|---|---|---|---|

for the numeral "2" from the one hour figure counter 7, the switching circuit $SW_1$ passes the character data

| 0 | 1 | 1 | 1 | 0 | 0 |
|---|---|---|---|---|---|

at the timing of the signal "h" and the preset circuit 24 holds the character data

| 0 | 1 | 1 | 1 | 0 | 0 |
|---|---|---|---|---|---|

at the timing signal $\phi_1$. This character data

| 0 | 1 | 1 | 1 | 0 | 0 |
|---|---|---|---|---|---|

is displayed at the timing of the "a" signal on the display 35.

Figure 9:
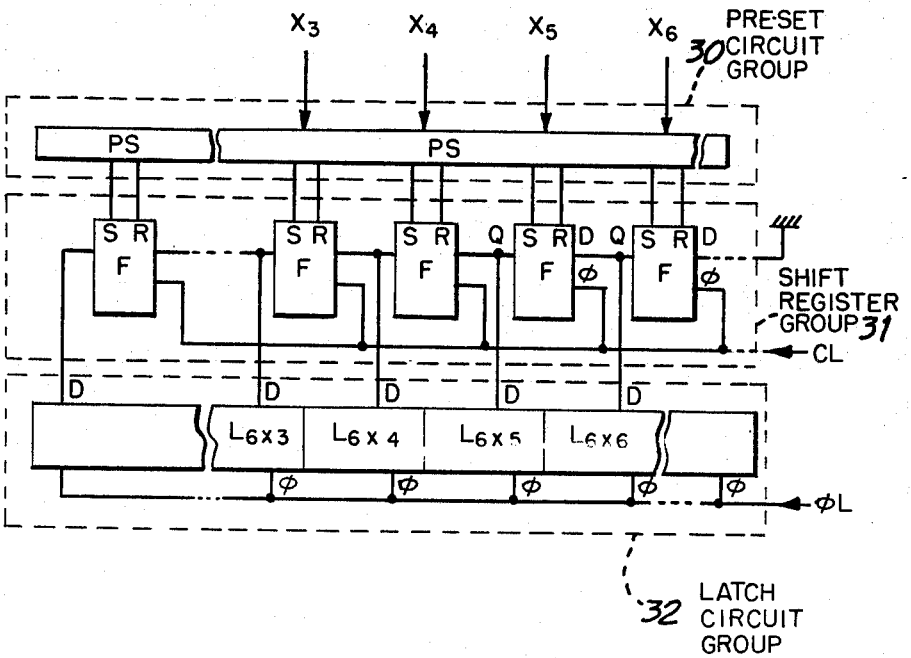
FIG. 9 is a circuit showing a shift register.

FIG. 9 shows a detailed shift register group 31. The shift register group 31 consists of a plurality of R-S flipflops.

As illustrated above, the present invention has the following advantages.

(1) The beautiful form of the character is practicable with the dot matrix display.

(2) A number of display information is legible by a single operation without changing over the display.

(3) A smooth and elegant timepiece is realized since the display is swept in turn in the left direction.

It is to be noted that the sweeping frequency is effective at frequencies other than 4 Hz and may be used in alarm timepieces and the like. Moreover, it is effective to display messages such as an alphabet other than numerals.

What is claimed is:

1. In an electronic timepiece having a dot matrix display, a time counting circuit, a character generator for decoding the counted content of the time counting circuit, shift means for temporarily retaining a lateral portion of the character pattern of the character generator, a longitudinal driver circuit for effecting the display of the content of the shift means by the dot matrix display, and a lateral driver circuit for providing a lateral signal to the dot matrix display, the improvement comprising: latch circuit means for retaining part of the lateral portion of the character pattern in the shift means, the latch circuit means having its input connected to the output of the shift means and its output connected to the input of the longitudinal driver circuit, and the memory capacity of the latch circuit means being smaller than the memory capacity of the shift means; shift pulse generating means operative when activated for applying a shift pulse to the shift means; and switch means for activating the shift pulse generating means.

2. An electronic timepiece according to claim 1; further comprising sweeping stop means for counting a sweep time and for inhibiting the generation of the shift pulse after the elapse of the sweep time.

3. An electronic timepiece according to claim 1; wherein the shift pulse generating means includes means for producing a plurality of shift pulse trains each different in frequency from the other.

4. An electronic timepiece according to claim 1; wherein the memory capacity of the latch circuit means is smaller by one character pattern than the memory capacity of the shift means.

5. A method of displaying a plurality of characters on a dot matrix display comprising: providing a character generator for generating character information in which one character is composed of m columns and n lines; and sequentially providing line information of the characters to a shift register by the steps of providing a plurality of character information of the first line to the n-th line to the shift register, providing part of the line information of the shift register to a latch circuit connected to the shift register, shifting the character displaying location on the dot matrix display by one column by applying one clock pulse to the shift register, executing the shifting step m times so that the character displaying location is shifted by one character, and shifting the character information to be stored in the shift register by one character thereby shifting by one character the location of the character on the dot matrix display.

* * * * *